United States Patent [19]

Takahashi

[11] Patent Number: 5,053,816

[45] Date of Patent: Oct. 1, 1991

[54] APPARATUS FOR DETECTING WHETHER A REPLACEABLE CARTRIDGE IS NEW OR USED IN AN IMAGE FORMING APPARATUS

[75] Inventor: Tomohiko Takahashi, Tokyo, Japan

[73] Assignee: Kabushiki Kaisha Toshiba, Kanagawa, Japan

[21] Appl. No.: 518,735

[22] Filed: Mar. 28, 1990

[30] Foreign Application Priority Data

Mar. 31, 1989 [JP] Japan ..... 1-083590

[51] Int. Cl.[5] ..... G03G 15/00

[52] U.S. Cl. ..... 355/208; 355/245

[58] Field of Search ..... 355/209, 208, 203, 245, 355/246, 260

[56] References Cited

U.S. PATENT DOCUMENTS 4,956,668 9/1990 Arnold et al. ..... 355/208

*Primary Examiner*—R. L. Moses

*Attorney, Agent, or Firm*—Banner, Birch, McKie & Beckett

[57] ABSTRACT

A laser printer includes a photosensitive drum, a developing device, a transferring device, and a fixing device. The photosensitive drum and the developing device are mounted along with a process cartridge within one body. The process cartridge is detachably inserted into the body. When the process cartridge is out of the body, the state of the process cartridge is treated as being "new". The state of the process cartridge is changed from the "new" state to a "used" state after an initializing operation of the process cartridge after it is completed and inserted into the body.

11 Claims, 7 Drawing Sheets

APPARATUS FOR DETECTING WHETHER A REPLACEABLE CARTRIDGE IS NEW OR USED IN AN IMAGE FORMING APPARATUS

BACKGROUND OF THE INVENTION

1. Field of the Invention

The present invention generally relates to an image forming apparatus, and more particularly is directed to an image forming apparatus which automatically determines the state and condition of image forming elements within the apparatus. When necessary, the image forming elements are initialized to a desired state.

2. Description of the Related Art

An image forming apparatus, such as a copier or laser printer, employs electrophotographic image forming techniques. Using these techniques, a latent image is formed on a photosensitive drum. A developing device develops the latent image using a toner which makes the latent image visible. A problem arises, however, in that it is difficult to convey only the toner to the photosensitive drum during the developing process.

Thus, a toner carrier, such as a magnetic powder, is used which allows only the toner to be easily conveyed in order to form a high quality image. However, it is necessary to mix the toner and toner carriers together before forming the image.

The toner is consumed during every image formation so that it is necessary to re-supply the toner after a plurality of images are formed. As is well known, a toner sensor automatically detects the quantity of residual toner, i.e., the density of the toner, in the developing device. The toner sensor generates a signal indicating that toner density is equal to or less than a predetermined value. Thus, the image forming apparatus supplies toner to the developer in response to the density signal. It is important to determine the predetermined density value in order to adequately supply the toner. Usually, the predetermined value is determined on the basis of an initial value of toner density.

It is necessary to mix the toner and the toner carriers together in order to correctly measure the initial value. This is because the toner sensor measures toner density on the basis of the magnetic characteristic of the mixture of the toner and the toner carriers.

A conventional image forming apparatus performs an initial operation to mix together the toner and the toner carriers and to determine the initial value of toner density of the mixture.

The initial operation must be performed only when a new developing device is inserted into the image forming apparatus. This is due to variations in the characteristics of the mixture of toner and toner carriers which occur during storage of the mixture. Thus, the image forming apparatus performs the initializing operation in response to insertion of the new developing device. However, a user may turn off the power to the image forming apparatus before the initializing operation is complete. When power is restored, it is not possible to perform the initializing operation.

SUMMARY OF THE INVENTION

Accordingly, it is an object of the present invention to provide an image forming apparatus which reliably performs the initializing operation.

It is another object of the present invention to provide an image forming apparatus which reliably determines whether a detachable developing device is new or used.

In accordance with the present invention, the above-stated objects are achieved by providing an image forming apparatus for forming an image on an image carrier by a developer. The apparatus includes a body, and a developing device detachably located within the body for developing the image on the image carrier. An initializing device initializes the apparatus, including the developing device, in response to the location of the developing device within the apparatus. A setting device sets the state of the developing device to a used state after the initializing device has completed initializing the apparatus.

BRIEF DESCRIPTION OF THE DRAWINGS

Other objects and many of the attendant advantages of this invention will be readily appreciated as the invention becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
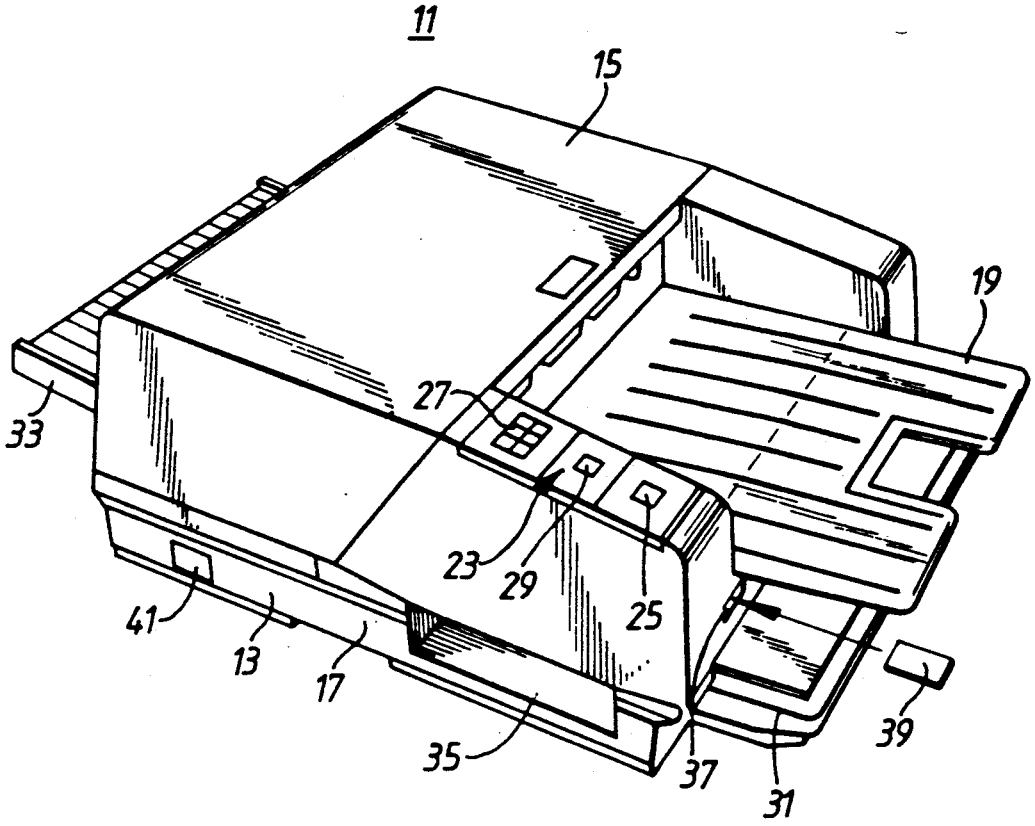
FIG. 1 is a perspective view of a laser printer according to the present invention.

Referring now to FIG. 1, an image forming apparatus, such as a laser printer 11, serves as an output device for a host computer (not shown). In response to a print command from the host computer, laser printer 11 forms an image on a paper sheet according to data supplied from the host computer and feeds the paper sheet out to the user via tray 19.

Figure 2:
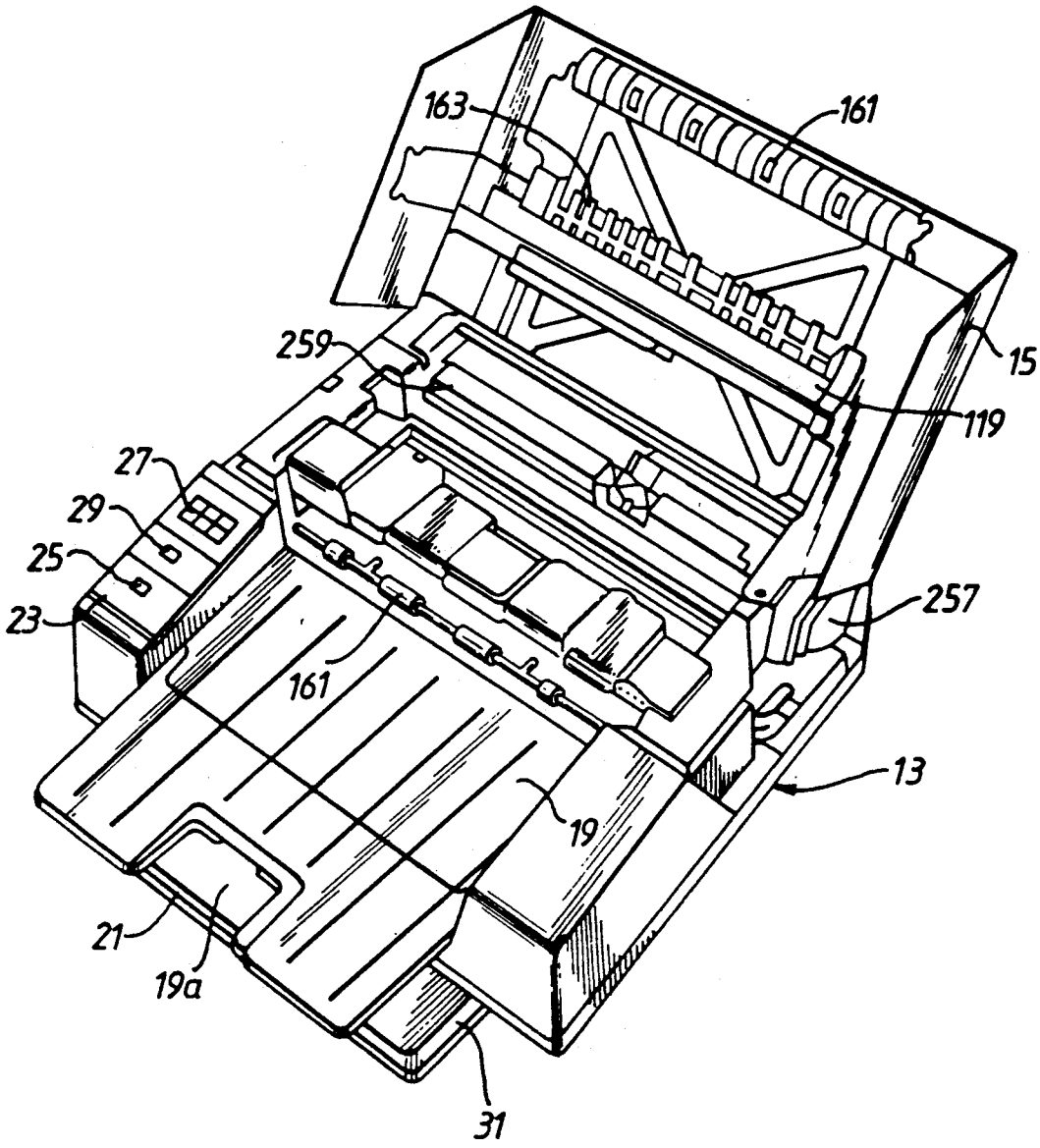
FIG. 2 is a perspective view of the laser printer when an operator lifts up a top cover of the printer shown in FIG. 1.

Laser printer 11 includes a body 13 formed of an upper cover 15 and a lower frame 17. Upper cover 15 covers part of the upper portion of body 13. Upper cover 15 is mounted by a hinge to body 13 and may be opened away from frame 17 as shown in FIG. 2. An output tray 19 is located on the other part of the upper portion of body 13 and receives the printed paper sheet output from the printer. Output tray 19 has a notch **19*a* located in the middle of the front end of output tray 19. A supplemental tray 21 is located at notch 19*a*** and can be withdrawn or retracted into the printer as needed in order to accommodate various sizes of paper sheets.

Figure 3:
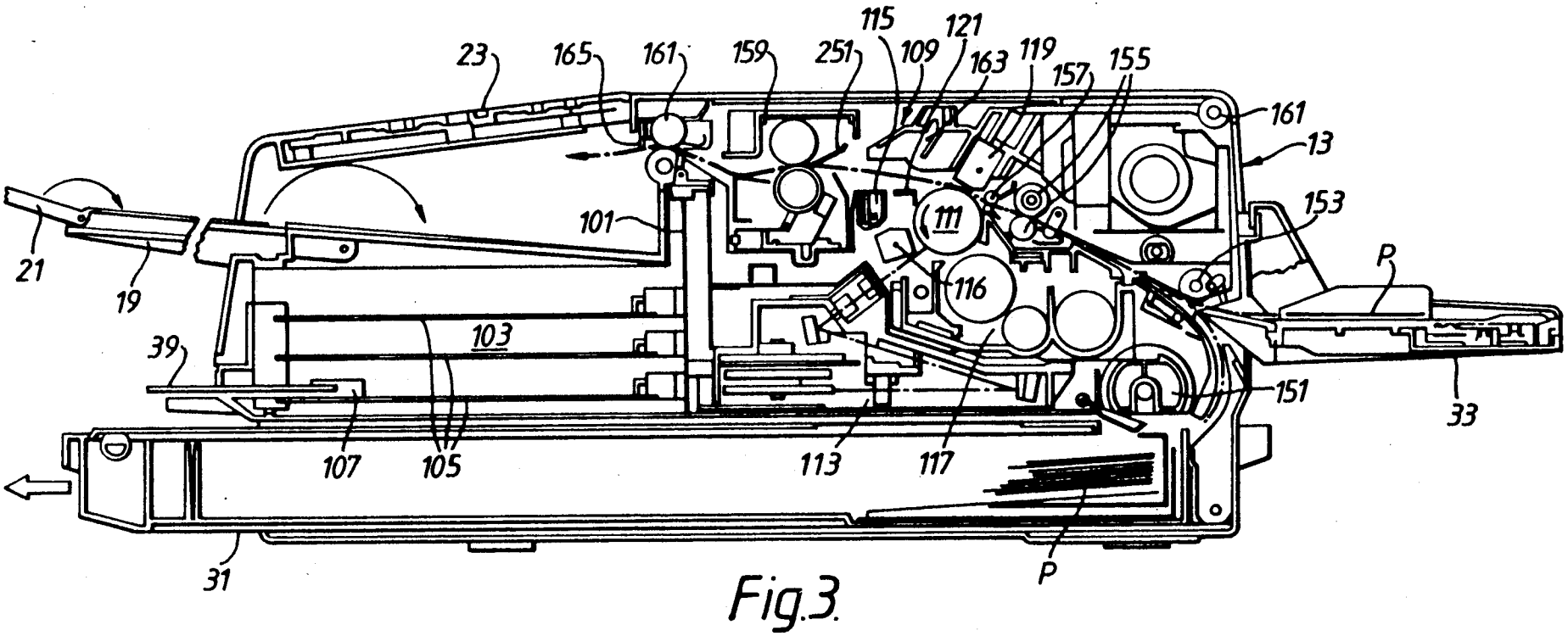
FIG. 3 is a sectional view of the laser printer shown in FIG. 1.

A control panel 23 is located on an end surface of body 13 adjacent output tray 19. Control panel 23 includes switch 25 for choosing an operating mode for the printer. Control panel 23 includes a plurality of visual displays, such as status indicator 27 and number indicator 29. Status indicator 27 indicates the operating status of the printer via a plurality of light-emitting diodes. Number indicator 29 indicates the number of sheets which have been printed, or, a print error code upon detection of a printing error. Paper supply cassette 31 is inserted into a lower portion of body 13, located under output tray 19. Hereinafter, the side of printer 11 into which cassette 31 is inserted will be referred to as the front side of the printer. Cassette 31 holds a supply of paper sheets P as shown in FIG. 3. A manual feed tray 33 is inserted into the rear side of body 13. Feed tray 33 is used as a guide for manually feeding individual paper sheets for printing. An I/O connector 35 is located on the left side surface of body 13. A plug (not shown) for electrically connecting printer 11 to the host computer is inserted into I/O connector 35. Body 13 includes an input port 37 for receiving programming cartridge or card 39 for automatically programming various print styles and fonts as is known in the prior art.

A power switch 41 is located on a side surface of body 13. When power switch 41 is operated, electrical power is supplied to laser printer 11.

Referring now to FIG. 3, the internal construction of laser printer 11 will be described.

A main control board 101 is located near the center of body 13. Control board 101 contains a CPU and related circuitry. An area 103 is located adjacent main control board 101 as shown in FIG. 3. Area 103 provides space for a plurality of additional circuit boards, e.g., boards 105, to be mated to control board 101. In the present embodiment, area 103 can accommodate up to three additional circuit boards. Area 103 may also be enlarged to accommodate more circuit boards if necessary or made smaller if additional boards are needed. A connector 107 is located at the lowermost portion of area 103. A programming cartridge or IC card may be plugged into connector 107 for programming special printer functions. Connector 107 is coupled to inlet 37 (See FIG. 1). When an IC card 39, for example, is inserted into inlet 37, the card connects to connector 107 which in turn electrically connects the card to control board 101. An interface connector (not shown) may be plugged into interface connector 35 in order to connect the printer to a host computer or such other devices which require printed images.

An image forming unit 109 is located to the right of control board 101 as shown in FIG. 3. Image forming unit 109 forms an image on paper sheet 8. According to the present invention, laser printer 11 employs an electrophotographic image forming technique.

Image forming unit 109 includes a photosensitive drum 111 for forming a latent image in response to light. Photosensitive drum 111 is rotated by an electric motor. A laser unit 113 radiates a laser beam in response to data supplied from a host computer so that a latent image is formed on the surface of drum 111.

A developing unit 117 is located "down stream" along the rotational direction of photosensitive drum 111. Developing unit 117 develops the latent image with a toner in order to generate a toner image and also cleans the surface of photosensitive drum 111 at the same time. A transferring unit 119 is located down stream of developing unit 117 along the rotational direction of photosensitive drum 111. Transferring unit 119 transfers the toner image onto paper sheet 8 supplied from cassette 31. A discharging unit 115 and a charging unit 116 are located up stream of laser unit 113 along the rotational direction of photosensitive drum 111. Discharging unit 115 includes a lamp for radiating the surface of photosensitive drum 111 in order to set the electrical potential of the surface of photosensitive drum to a uniform level. After the electrical potential of the surface of the drum is set, charging unit 115 charges the entire surface of drum 111 in order to prepare the surface for forming a latent image.

A brush 121 is located down stream of transferring unit 119 along the rotational direction of photosensitive drum 111. Brush 121 scrapes residual toner from the surface of photosensitive drum 111.

Along with the operation of forming a latent image on drum 111, paper sheet P is transported from cassette 31 or from manual feeding tray 3. A pickup roller 151 in located at the top end of cassette 31 when cassette 31 is inserted into body 13 of the printer, as shown at the right side of body 13 in FIG. 3. Pickup roller 151 has a cross-sectional shape of a half-moon, i.e., roller 151 has a flat surface. When the flat surface of pickup roller 151 faces cassette 31, pickup roller 151 is out of contact with paper sheet P. However, when the curved surface of pickup roller 151 faces cassette 31, pickup roller 151 is in contact with paper sheet P which allows the roller to pick up a paper sheet during its rotation.

Paper sheet P, when picked up by roller 151 from cassette 31, is transported to a position (hereinafter referred to as the image transferring position) at which transferring unit 119 faces photosensitive drum 111 through a pair of conveying roller 153, a pair of aligning rollers 155 and a pair of conveying rollers 187. The details of these rollers 153, 155 and 157 will be described below.

In normal operation, paper sheet P comes from feeding tray 33. However, when paper sheet P is fed manually, conveying rollers introduce paper sheet P to the image transferring position. Prior to setting paper sheet P on manual feeding tray 33, the user may designate a manual feeding mode on control panel 23 which causes printer 11 to form the image on paper sheet P supplied from manual feeding tray 33. In response to the selection of the manual feeding mode or the cassette tray mode, the CPU controls the operation of image forming unit 109 accordingly. Note that paper sheet P is fed from cassette 31 synchronously with the image forming operation in the cassette tray mode in which paper sheet P is automatically supplied from cassette 31.

Paper sheet P is transported from cassette 31 or manual feeding tray 33 to output tray 19. A fixing unit 159 is located at the down stream end to the transferring position. Fixing unit 159 fixes the toner image onto paper sheet P by heating and pressing paper sheet P with the toner image.

A pair of eject rollers 161 is located at a further down stream position to fixing unit 159. Eject rollers 161 eject paper sheet P with the fixed toner image onto receiving tray 33.

Guide 163 is located between the transferring position and fixing unit 159. Guide 163 is made from metal and is electrically grounded to printer 11. During the image forming operation, guide 163 faces a side surface (hereinafter referred to as a non-image surface) of paper sheet P, on which there is no toner image. Thus, guide 163 electrostatically attracts paper sheet P toward guide 163 without disturbing the toner image on the back surface of paper sheet P.

A discharging brush 165 is located at a down stream position to eject rollers 161. Discharging brush 165 is brought into contract with the non-image surface of paper sheet P immediately after eject rollers 161 ejects paper sheet P into output tray 19 with the toner image.

Upper cover 15 is pivotally fixed to body 13 through an axis 161 located at an upper portion of the rear side of body 13. Upper cover 15 can be separated from body 13 as shown in FIG. 2. Upper cover 15 includes transferring unit 119, guide 163, an upper roller of the pair of eject rollers 161 and discharging brush 165. When upper cover 15 is separated from body 13, the paper sheet path from conveying rollers 183 to eject rollers 161 is exposed to allow the clearing of misfeeds and jams.

Figure 4:
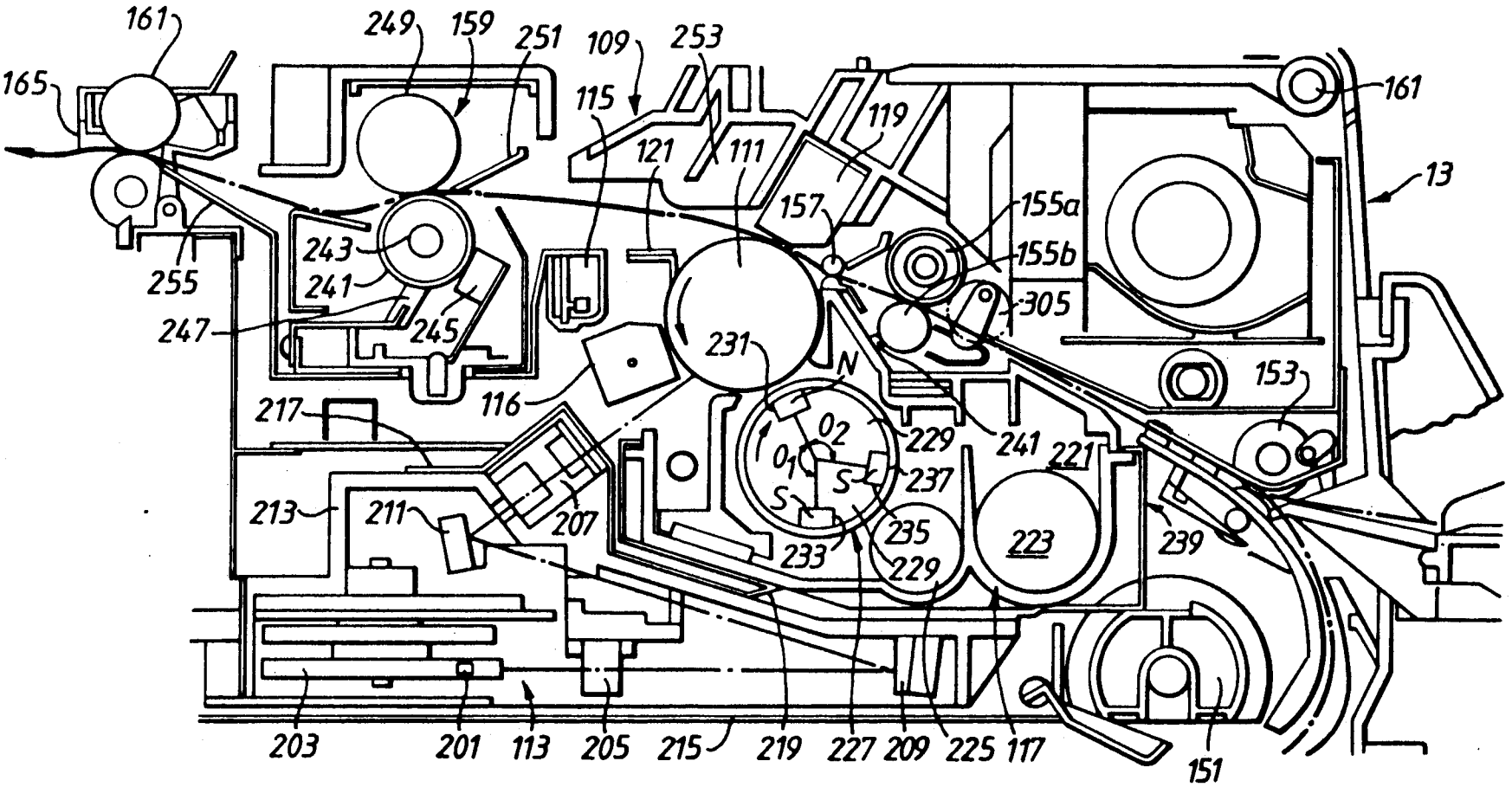
FIG. 4 is a local sectional view of the laser printer shown in FIG. 1.

Referring now to FIG. 4, the detail of image forming unit 109 will be explained.

Laser unit 113 includes a semiconductor laser 201 for generating a laser beam in response to data supplied from the host computer. A mirror, such as a polygon mirror 203, reflects the laser beam so that the laser beam scans the surface of photosensitive drum 111 through a first and a second lens 205 and 207 and first and second mirrors 209 and 211. The detail of laser unit 113, especially, first and second lens 205 and 207, i.e., FO lens, is disclosed in U.S. patent application Ser. No. 454,947 filed Dec. 22, 1989, which is herein incorporated by reference. Laser unit 113 is mounted in casing 213 made of synthetic resin. A metallic shielding board 215 is used to cover an opening located at the base of casing 213. Metallic shielding board 215 is detachably fixed to the opening. A metal shield cover 217 is located at the top surface of casing 213. Shield cover 217 is coupled to a conductive strip 219. As described below, a process cartridge, including developing unit 117, is detachably inserted into body 13. When developing unit 117 is inserted into body 13, conductive strip 219 is brought into contact with a metallic guide rail for guiding developing unit 117 into body 13. The above construction of casing 213 prevents static electricity generated during the image forming operation from affecting various components in laser unit 113, e.g., semiconductor laser 201.

Photosensitive drum 111 has first and second layers located on an aluminum tube. The first layer, located on the surface of the aluminum tube, generates a plurality of carriers in response to the laser light generated by laser unit 113. The second layer, located on the first layer, transports the carriers generated in the first layer. The operation of drum 111 is disclosed in U.S. Pat. No. 4,722,879 which is herein incorporated by reference.

The operation of developing unit 117 will now be explained. Developing unit 117 includes a container 221 which contains a two-element developer comprising a toner and a toner carrier. The developer may be formed of a magnetic powder therein. Container 221 includes first and second stirrers 223 and 225 for mixing the toner and the toner carrier together.

Developing roller 227 transports the mixture of toner and toner carrier to a developing position facing the surface of photosensitive drum 111. Developing roller 227 includes a magnetic roller 229 with a plurality of magnetic poles, e.g., first, second, and third magnetic poles 231, 233, and 235. An angle $O_2$ between first and second magnetic poles 231 and 233 is 150 degrees. An angle $O_2$ between first and third magnetic poles 231 and 235 is 120 degrees. First pole 231, is a N-pole facing the developing position. Second and third poles 233 and 235 are S-poles.

A non-magnetic sleeve 237 is slipped over the periphery of magnetic roller 228. Non-magnetic sleeve 237 is rotated while magnetic roller 229 is fixed.

In the present embodiment, laser printer 11 employs a reverse development process and uses a two-component development agent. It is unnecessary to clean the surface of drum 111 before the next image formation. The detail of this mechanism is disclosed in U.S. Pat. No. 4,004,504, which is incorporated herein by reference.

Photosensitive drum 11, charging unit 116, developing unit 117 and brush 121 are mounted in a process cartridge 239 as one body. Process cartridge 239 is detachably inserted into body 13. A cleaning brush 241, located on the top surface of process cartridge 239, is brought into contact with a lower aligning roller **155*b* of the pair of aligning rollers 155 in order to clean the surface of lower aligning roller 155*b***.

Fixing unit 159 comprises a heat roller 241 which includes heating element 243 for generating heat. A thermister 245 is in contact with the surface of heat roller 241 in order to detect the temperature of the surface of the heat roller. The detected temperature is used to control the temperature of the surface of heat roller 241 at a constant level. A cleaner 247 also is maintained in contact with the surface of heat roller 241 in order to keep the surface of heat roller 241 clean.

Fixing unit 159 comprises a pressure roller 249 in contact with heat roller 241. Paper sheet P with the toner image is conveyed between heat and pressure roller 241 and 249, guided by a paper guide 251. Paper guide 251 is located at an up stream position relative to paper sheet P so that the leading edge of paper sheet p is received between heat and pressure rollers 241 and 243.

Image forming device 109 includes paper guides 253 and 255. Paper guide 253 is located between transferring unit 119 and fixing unit 159 so that paper guide 253 can guide paper sheet P into fixing unit 159. Paper guide 255 is located between fixing unit 159 and the pair of eject rollers 161 so that paper guide 255 can guide paper sheet P, with the toner image, between the pair of eject rollers 161.

Image forming device 109 comprises a toner cartridge 257 which contains a plurality of toner. Container 221 is provided with toner in accordance with the consumption of toner in developing unit 117 as shown in FIG. 2. A toner sensor detects the toner density of developing unit 117. When the toner density detected by the toner sensor is less than a predetermined value, toner cartridge 257 supplies container 221 with toner in response to a toner request signal provided by the toner sensor. The predetermined value is determined on the basis of an initial value of the toner density in container 221 when process cartridge 239 is inserted in body 13. Than is, after the toner and the toner carriers are mixed together, the toner sensor measures the toner density of container 221 on the basis of the magnetic characteristic of the mixture of toner and toner carriers. The density value is treated as an initial value of toner density. The initial value of density depends on each process cartridge 239. The predetermined value is set at a third or fourth of the initial value as measured by the toner sensor. Therefore, each process cartridge 239 has its own predetermined value of toner density.

Before process cartridge 239 is inserted into body 13, process cartridge 239 is normally left to sit for a long period of time waiting to be used. The toner sensor, on the basis of magnetic characteristics of the toner, may fail to correctly measure the toner density of process cartridge 239 which is left sitting for a long period time.

Therefore, it is necessary to re-mix the toner and toner carrier. The image forming device further comprises an ozone filter 259 for eliminating various unnecessary elements, such as ozone generated during the image forming operation.

The process of determining whether cartridge 239 is new or used will now be explained. The term "new" as used herein refers to a cartridge 239 which has never been used in laser printer 11. Thus, the toner and toner carriers have not been mixed together. The term "Used" as used herein refers to a cartridge 239 which has been previously used and thus the toner and toner carriers have been mixed together.

Figure 5:
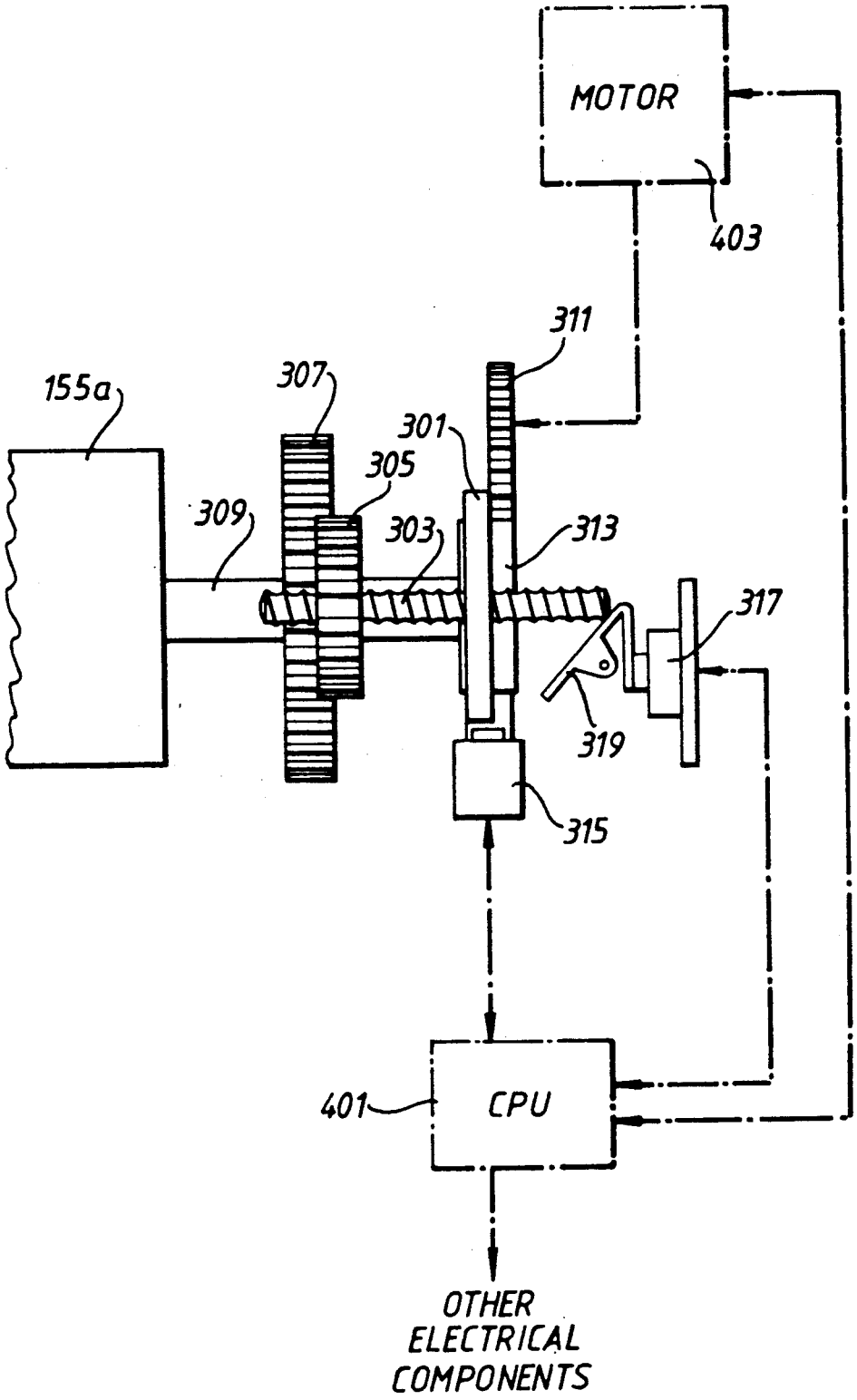
FIGS. 5 and 6 are side views of a principal part of the laser printer shown in FIG. 1, with certain parts omitted.

Referring now to FIG. 5, process cartridge 239 (See FIG. 4) includes a small plate 301 fixed on the outer surface of cartridge 239. Small plate 301 has a threaded hole therein. A screw 303 passes through the threaded hole and a first gear 305 is fixed near the end of screw 303.

When process cartridge 239 is inserted and set at a predetermined position in laser printer 11, first gear 305 engages with a second gear 307. An axis 309 of upper roller 155*a* of aligning rollers 155 engages second gear 307. Thus, second gear 307 is rotated along with upper roller 155*a*. In response to settlement of process cartridge 239, CPU 401 causes motor 403 to rotate upper roller 155*a* through a third gear 311 and spring clutch 313. Spring clutch 313 selectively transmits the rotational motion to roller 155*a* in response to the operation of a solenoid 315 which is controlled by CPU 401.

At the time that process cartridge 239 (hereinafter referred to as a setting time) is set in the predetermined position in laser printer 11, screw 303 triggers a detector, e.g., a microswitch 317, fixed to body 13. Detector 317 includes a rotatable arm 319 pulled by a spring toward screw 303, i.e., in the direction indicated by the arrow A shown in FIG. 5. At the setting time, first gear 305 is located to the right of second gear 307 such that first gear 305 engages second gear 307. At this time, screw 303 pushes rotatable arm 319 so that microswitch 317 is turned "ON", indicating that process cartridge 239 has been inserted. Thus, screw 303 does not push rotatable arm 319 so that microswitch 317 is turned "OFF" which indicates that process cartridge 231 is "used".

Figure 6:
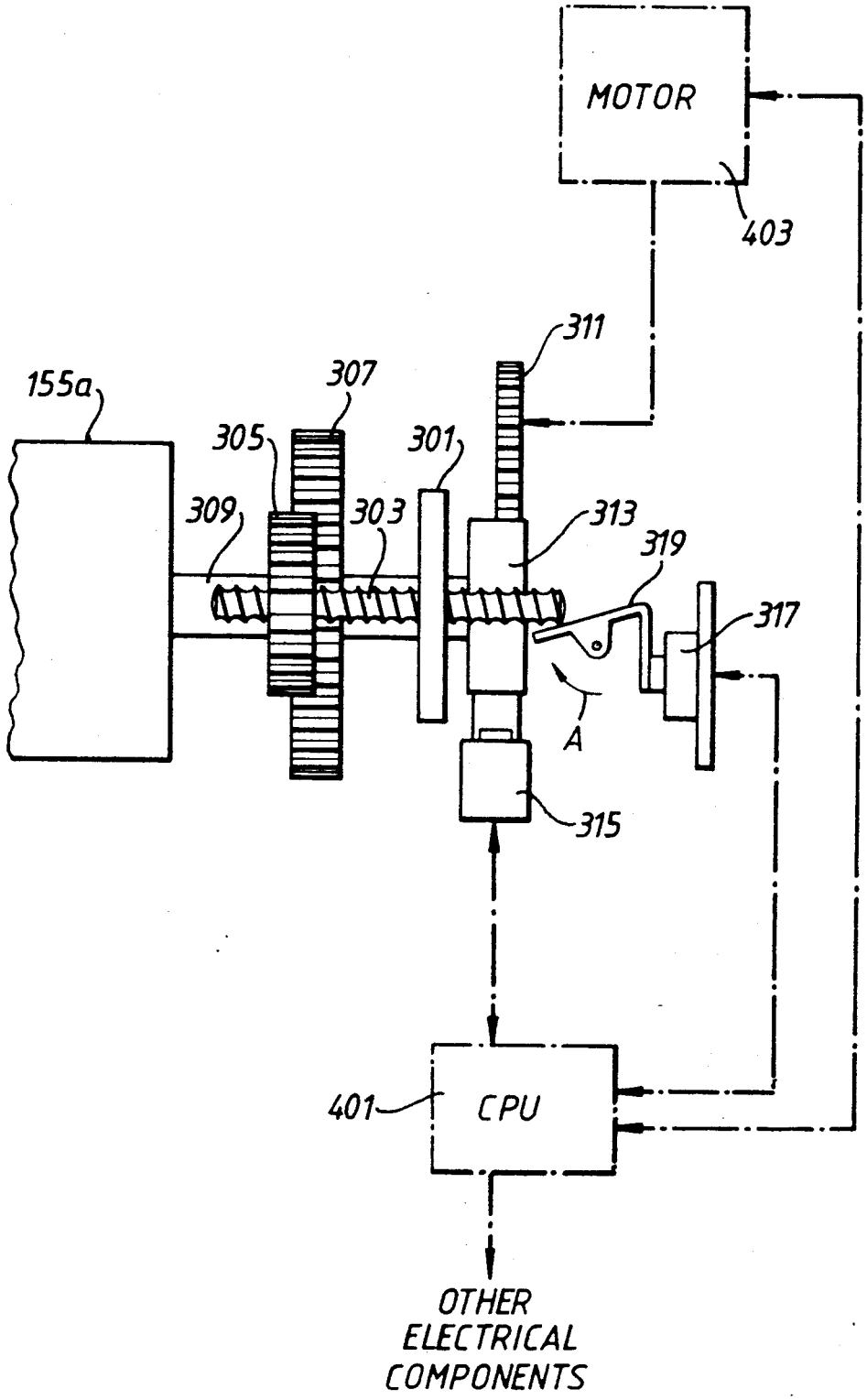

The movement of screw 303 will now be explained. When solenoid 315 operates, motor 403 rotates roller 155*a* through third gear 311 and spring clutch 313. In response to the rotation of roller 155*a*, second gear 307 is rotated. In response to the movement of second gear 307, first gear 305 is rotated so that screw 303 is moved to the left. When screw 303 is moved to the left by a predetermined amount, rotatable arm 319 is separated from the detecting surface of microswitch 317 so that microswitch 317 is turned "OFF" as shown in FIG. 6.

Figure 7:
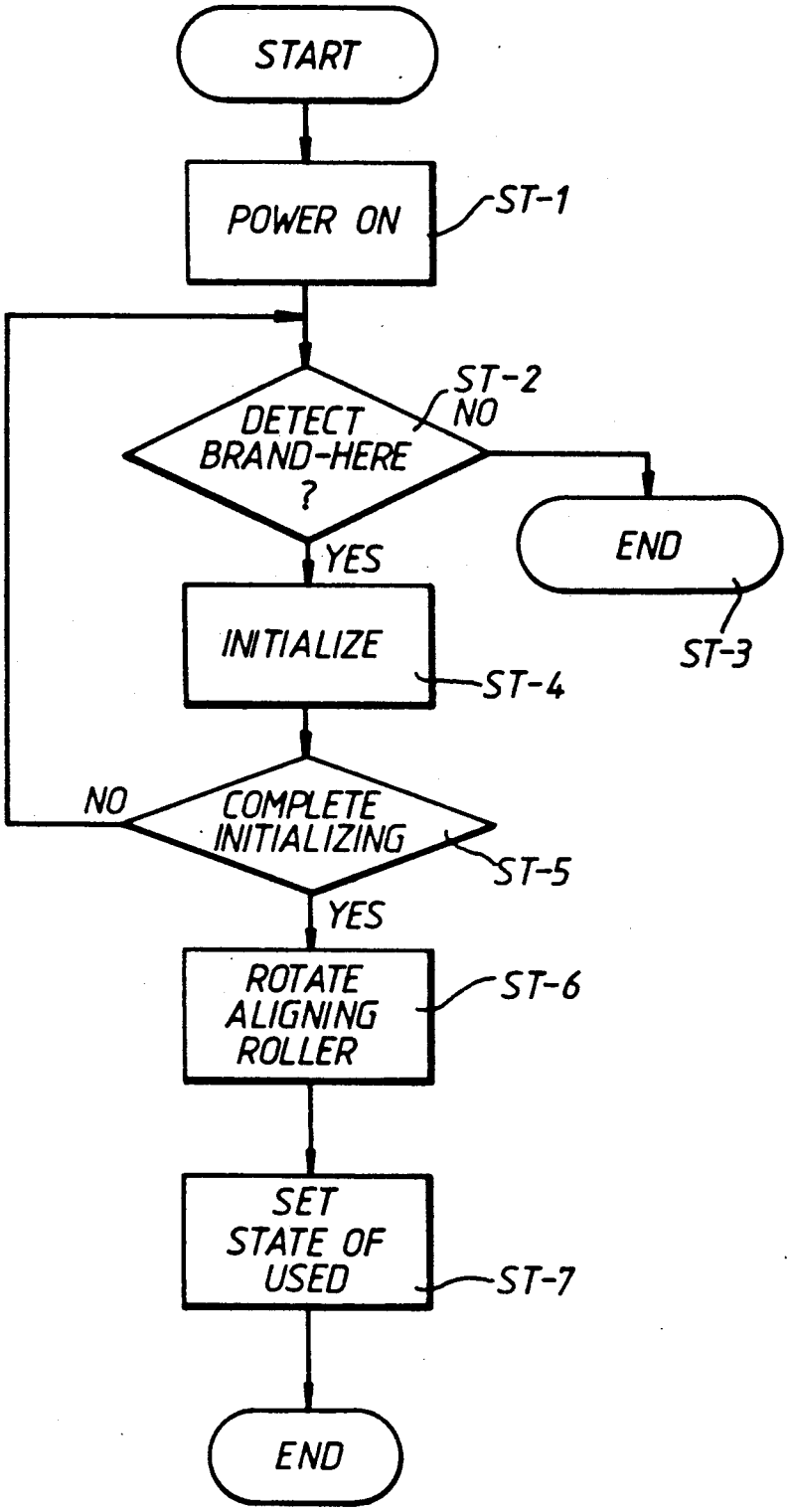
FIG. 7 is a flow chart illustrating the operation of detecting the state of the developing unit used in the laser printer shown in FIG. 1.

Referring now to FIG. 7, the operation of detecting whether process cartridge 239, especially how developing unit 117 is determined to be "new" or "used", is explained.

The user initially inserts process cartridge 239 into body 13 so that the cartridge is located at the predetermined position. The user then operates power switch 41 (step 1).

CPU 401 detects whether process cartridge 239 is "new" (step 2). That is, CPU 401 detects whether microswitch 317 is "ON". When a new process cartridge 239 is inserted into body 13, microswitch 317 is turned "ON" as shown in FIG. 5.

When microswitch 317 is "OFF", process cartridge 239 is determined to be "used" so that no initial operation is needed. The operation, therefore, ends (step 3).

When microswitch 317 is "ON", CPU 401 performs an initial operation (step 4). This operation initializes cartridge 239, i.e., toner to mix the toner and the toner carriers together within container 221.

First and second stirrers 223 and 225 are rotated for a predetermined time in order to mix the toner and toner carriers together. After mixing, the toner sensor measures the initial value of toner density in process cartridge 239. The toner sensor provides a toner request signal to cause toner cartridge 257 to supply the toner to container 221 of process cartridge 239 when the toner density is less than the predetermined value determined on the basis of the initial value. During the initial operation described above, spring clutch 13 does not transmit the rotational motion of third gear 311 to roller 155*a*.

CPU 401 then detects whether the initial operation is complete (step 5). If the initial operation is not complete, CPU 401 returns to step 2. If the initial operation is completed, however, CPU 401 causes aligning rollers 155 to rotate (step 6). Thus, CPU 401 turns on solenoid 315 so that spring clutch 313 can transmit the rotational motion of third gear 311 to roller 155*a*. As roller 155*a* is rotated by motor 403 through third gear 311 and spring clutch 313, upper roller 155*a* of aligning rollers 155 is thus rotated along with first and second gears 305 and 307. In response to the rotation of first gear 305, screw 303 is screwed into small plate 301 which is fixed to process cartridge 239. As screw 303 is screwed into small plate 301, first gear 305 is moved to the left as shown in FIGS. 5 and 6. When first gear 305 is moved to the left so that first gear 305 is located left of second gear 307, second gear 307 cannot rotate first gear 305. Thus, first gear 305 is stationary. At the same time, rotatable arm 319 is pivotally moved by a spring as shown in FIG. 6. Thus, microswitch 317 is turned "OFF". CPU 401 detects the "OFF" condition of microswitch 317 and determines that process cartridge 239 has been "used" (step 7). The operation of detecting the condition of process cartridge 239 is thus completed. If the power to printer 11 is turned off during the initial operation in step 2, CPU 401 treat process cartridge 239 as being "new." This is because the condition of process cartridge 239 is set to "used" after completing the initial operation.

Other objects, features and advantages of the present invention will become apparent from the above detailed description. It should be understood, however, that the detailed description and specific examples, while indicating preferred embodiments of the invention, are given by way of illustrations only, since various changes and modifications within the spirit and scope of the invention will become apparent to those skilled in the art.

What is claimed is:

1. An image forming apparatus for forming an image on an image carrier, said apparatus comprising:

image forming means for forming said image on said image carrier;

developing means for developing said image formed on said image carrier, wherein said developing means is formed of a mixture of toner and toner carriers;

mixing means for mixing said toner and said toner carriers to form said mixture;

detecting means for detecting whether said toner and said toner carriers have been mixed together, and means for setting the state of said developing means to a used state in response to the detecting result by said detecting means.

2. An image forming apparatus for forming an image on an image carrier by a developer, the apparatus comprising:

a body;

developing means, detachably located in the body, for developing the image on the image carrier by the developer;

initializing means for initializing the apparatus including the developing means in response to the location of the developing means within the apparatus; and means for setting the state of the developing means to a used state after the initializing means has completed initializing the apparatus including the developing means, the setting means including, a screw device, moving means for moving said screw device, detecting means for detecting whether said screw device is located in a predetermined position, prohibiting means for prohibiting the moving means from moving said screw device while the initializing means initializes said apparatus, and state setting means for changing the state of said developing means from new to used in response to the detection by said detecting means.

3. An image forming apparatus for forming an image on a recording medium, said apparatus comprising:

photosensitive surface means for forming said image;

image forming means for forming said image or said photosensitive surface means;

developing means for developing said image formed on said image forming means, wherein said developing means is formed of a mixture of toner and toner carriers and mixing means for mixing said toner and said toner carriers together to form said mixture;

transfer means for transferring a developed image from said photosensitive surface to said recording medium; and indicating means for indicating whether said toner and said toner carriers have been mixed together, said indicating means being formed of a displacement marker and displacement marker drive means for driving said displacement marker to a first predetermined position when said toner said toner carriers have not been mixed together and a second predetermined position when said toner and said toner carriers have been mixed together.

4. The apparatus of claim 3, wherein said displacement marker drive means is formed of gear means.

5. The apparatus of claim 4 wherein said displacement marker drive means is formed of a driven gear driven by a drive gear, said driven gear being in driving engagement with said drive gear when said toner and said toner carriers have not been mixed.

6. The apparatus of claim 5 wherein said driven gear is out of driving engagement with said drive gear when said toner and said toner carriers have been mixed.

7. The apparatus of claim 6 wherein said indicating means further includes switch means for indicating the position of said displacement marker means.

8. The apparatus of claim 7 wherein said driven gear is coupled to shaft means, said shaft means being used to operate said switch means.

9. The apparatus of claim 8 wherein said shaft means is a screw.

10. The apparatus of claim 9 wherein said screw is threadedly received within stationary means.

11. The apparatus of claim 10 wherein the movement of said screw through said stationary means causes said driven gear to be in and out of engagement with said drive gear.

* * * * *